United States Patent [19]

Fehrer

[11] Patent Number: 4,672,800

[45] Date of Patent: Jun. 16, 1987

[54] PROCESS AND APPARATUS FOR MAKING A YARN

[76] Inventor: Ernst Fehrer, Auf der Gugl 28,, A-4020 Linz, Austria

[21] Appl. No.: 868,576

[22] Filed: May 30, 1986

[30] Foreign Application Priority Data

| | | | |
|---|---|---|---|
| Oct. 24, 1985 | [AT] | Austria | 3070/85 |
| Nov. 21, 1985 | [AT] | Austria | 3390/85 |
| Jan. 20, 1986 | [AT] | Austria | 118/86 |
| Mar. 13, 1986 | [AT] | Austria | 658/86 |

[51] Int. Cl.[4] ..... D01H 1/135; D01H 7/885; D01H 5/28; D02G 3/36

[52] U.S. Cl. ..... 57/5; 57/328; 57/331; 57/334; 57/401; 57/409; 57/410

[58] Field of Search ..... 57/5, 6, 328, 331, 334, 57/400, 401, 408–413

[56] References Cited

U.S. PATENT DOCUMENTS

| | | | |
|---|---|---|---|
| 4,107,909 | 8/1978 | Fehrer et al. | 57/5 |
| 4,168,601 | 9/1979 | Didek et al. | 57/401 |
| 4,183,202 | 1/1980 | Morihashi | 57/328 |
| 4,222,222 | 9/1980 | Didek et al. | 57/401 |
| 4,241,571 | 12/1980 | Turk et al. | 57/5 X |
| 4,249,368 | 2/1981 | Fehrer | 57/5 |
| 4,281,507 | 8/1981 | Didek et al. | 57/401 |
| 4,322,944 | 4/1982 | Sraitr et al. | 57/328 |
| 4,327,545 | 5/1982 | Fehrer | 57/5 |
| 4,483,136 | 11/1984 | Stahlecker et al. | 57/401 |
| 4,524,580 | 6/1985 | Fehrer | 57/401 |
| 4,574,572 | 3/1986 | Fehrer | 57/5 |

FOREIGN PATENT DOCUMENTS 377018 6/1984 Austria .

*Primary Examiner*—John Petrakes
*Attorney, Agent, or Firm*—Kurt Kelman

[57] ABSTRACT

In the making of a yarn, a stream of drawn core fibers (17*a*) is twisted in a triangular twisting space (4) between two juxtaposed, closely spaced apart twisting drums (1, 2), which are rotated in the same sense, and covering fibers are wound about said stream of fibers in said twisting space. To make said yarn from a single roving (17), the drawn roving (17) is fed to the twisting space (4) on the circumference of a feed roller (8), to which a vacuum is applied, the roving which has been fed on said feed roller is divided into two streams of fibers (17*a,* 17*b*) before reaching the twisting space (4), one (17*a*) of said streams of fibers is intended to constitute the core of the yarn to be made and is moved on the feed roller (8) as far as to the twisting space (4), and the other (17*b*) stream of fibers consists of the covering fibers and is detached from the feed roller (8) and its fibers are caused to fly freely into the twisting space (4).

16 Claims, 5 Drawing Figures

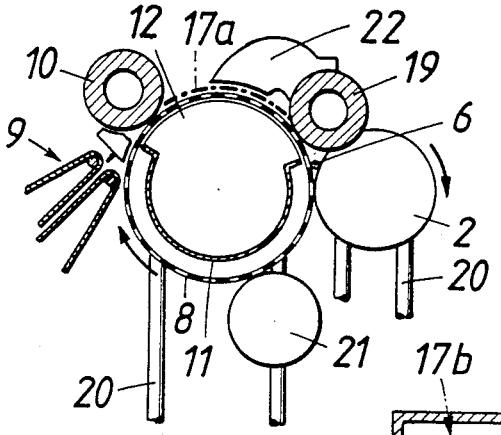
FIG. 3
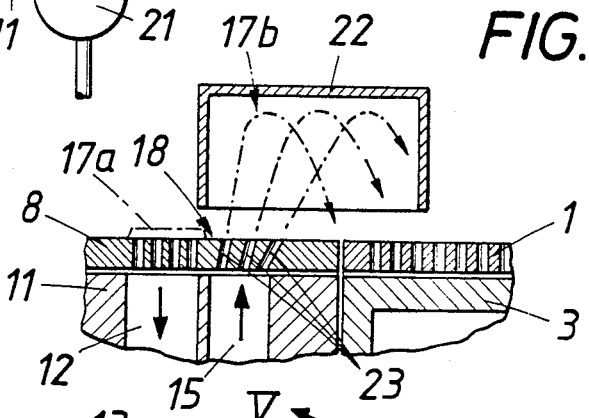
FIG. 5
FIG. 4
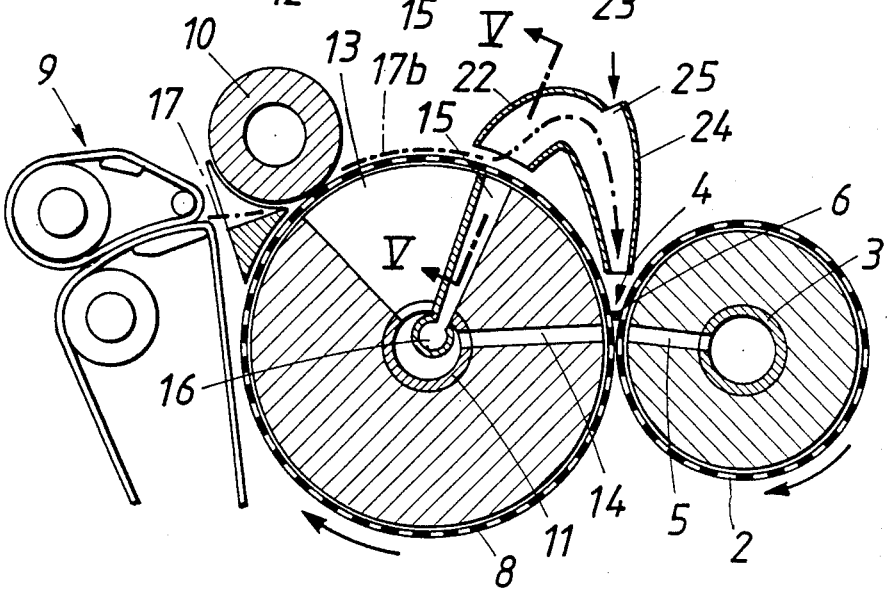

PROCESS AND APPARATUS FOR MAKING A YARN

BACKGROUND OF THE INVENTION

1. Field of the Invention

This invention relates to a process of making a yarn wherein a stream of drawn core fibers is twisted in a generally triangular twisting space defined by two juxtaposed, closely spaced apart twisting drums rotating in the same sense, and covering fibers are wound on said stream of fibers in said space, and to apparatus for carrying out the process.

2. Description of the Prior Art

It is desired to prevent an untwisting in a false-twisting sense of the fibers of a drawn roving which has been twisted in the triangular twisting space defined by two twisting drums which rotate in the same sense and to ensure an adequate cohesion of the twisted fiber structure. This can be accomplished in that covering fibers are wound around the drawn roving as it is twisted in the twisting space. The covering fibers to be wound around the roving are parallelized in that they are drawn by means of a drawing frame and are moved with a constraint on a drum, which is coaxial to one of the two twisting frums rotating in the same sense and to which a vacuum is applied on part of its circumference. From Austrian Patent Specification No. 377,018 it is known that said parallelization and constraint can be utilized to make a uniform yarn of high strength if the drum for feeding the covering fibers is driven at a surface speed which differs from that of the twisting drums so that the fact that the twisting drums are rotated at a surface speed which is sufficient for the twisting of the drawn roving but is generally higher than the speed which can be tolerated for the feeding of the covering fibers cannot adversely affect the uniform winding of the covering fibers around the drawn roving. Whereas the alignment of the covering fibers as they enter the twisting space is an essential requirement for the making of uniform yarns of high strength, the quality of the yarns depends also on a proper tying of the covering fibers between the fibers of the drawn roving. Such tying will be more effectively achieved if the covering fibers fly freely into the twisting space. Besides, a relatively expensive structure is involved in the provision of two drawing frames for the roving to be twisted and for the covering fibers, respectively. Moreover, the roving from which the covering fibers are obtained cannot readily be drawn the high degree which may be desired so that particularly thin yarns may comprise a relatively high proportion of covering fibers.

SUMMARY OF THE INVENTION

For this reason it is an object of the invention to avoid said disadvantages and to provide a process by which a constraint of the core fibers entering the twisting space is ensured whereas the advantage is retained which will be afforded regarding the tying of the covering fibers into the roving if said covering fibers fly freely into the twisting space. It is also desired to use only one roving in the making of a yarn having a core and covering fibers wound around said core at a helix angle which differs from that of the core fibers so that high strengths can be achieved whereas the proportion of covering fibers is relatively low.

In a process of the kind described first hereinbefore that object is accomplished in accordance with the invention in that a drawn roving is fed to the twisting space on the circunference of a feed roller, to which a vacuum is applied, the roving which has been fed on said roller is divided into two streams of fibers before reaching the twisting space, one of said streams of fibers is intended to constitute the core of the yarn to be made and is moved on the feed roller as far as to the twisting space, and the other stream of fibers consists of the covering fibers and is detached from the feed roller and its fibers are caused to fly freely into the twisting space.

The division of the drawn roving into two streams of fibers affords the advantage that a single roving can be used as a starting material. The stream of core fibers is constrained continuously as it is fed to the twisting space by the feed roller, which is subjected at its circumference to a vacuum. The other stream of fibers consists of the covering fibers and is caused to enter the twisting space in a freely flying state. This mode of supplying the covering fibers into the twisting space permits a satisfactory tying of the covering fibers into the fibrous structure of the core of the yarn. Nevertheless the alignment of the covering fibers which is due to their constrained feeding on the feed roller is substantially preserved because the covering fibers are still sucked by the feed roller at their trailing ends as the leading ends of the covering fibers are detached from the feed roller. When the covering fibers have been detached from the feed roller, they are wound at a helix angle which differs from that of the core fibers because the core fibers are deflected through 90° as they move from the feed roller into the twisting space. The use of a single roving as a starting material affords also the advantage that the proportion of covering fibers will be relatively small if a usual draw ratio is employed.

The stream consisting of the covering fibers can be detached from the feed roller by means of an air blast which flows through the shell of the feed roller and which blows the fibers of that stream from the feed roller toward the twisting space. Alternatively, the covering fibers may be detached from the feed roller in that said fibers are sucked from the feed roller so that a comparable result will be obtained.

The process in accordance can be carried out by a known apparatus comprising two juxtaposed, closely spaced apart twisting drums, which rotate in the same sense and define a generally triangular twisting space, to which a vacuum is applied, fiber-feeding means and withdrawing means for withdrawing the yarn formed by the fibers which have been twisted together in the twisting space, if said apparatus is improved in that the fiber-feeding means comprise a feed roller, which is disposed at the receiving end of that twisting drum which at the triangular twisting space rotates toward the vertex of said space, and said feed roller is adapted to be driven in the yarn-twisting sense and comprises a circumference portion to which a vacuum is applied, and a blasting zone on that side of said circumference portion which is adjacent to the twisting drum.

Because a circumference portion to which a vacuum is applied and a blasting zone are axially juxtaposed, the roving which is fed on the feed roller toward the twisting drums is divided into two streams of fibers as those fibers of the roving which are fed in the axial region of the blasting zone will be blown from the feed roller as they reach the blasting zone whereas those fibers which are fed on the circumference portion to which a vacuum is applied will be constrained until they enter the twisting space. As a result, the fibers of the stream which is continuously constrained will constitute the core fibers of the yarn and the fibers which have been blown from the blasting zone will be wound around said core fibers under conditions which can be obtained only if the covering fibers fly freely into the twisting space. The air blast also causes the stream of blown-off fibers to be fanned over a larger axial length of the line of yarn formation so that the resulting yarn will be more uniform and will have a higher strengthh. In that connection it may be pointed out that the angle at which the individually blown-off fibers approach the line of yarn formation will vary over the axial extent thereof in which said covering fibers reach said line because the stream of covering fibers has been fanned out over said axial extent.

To order to distribute the fibers of the roving to the two streams of fibers in predetermined proportions, the feed roller may be subjected to a vacuum in a suction zone which is disposed on that side of the blasting zone which is opposite to the twisting space, and said suction zone may be separated by a zone to which no vacuum is applied from the constraining circumference portion to which a vacuum is applied. In that zone to which no vacuum is applied the roving is laterally pulled apart toward those two portions of the feed roller to which a vacuum is applied so that any coherence between the fibers disposed between the two zones to which a vacuum is applied will be eliminated. If the fibers of one of the two streams into which the roving has been divided are detached from the feed roller by a blast, that blast will not influence the other stream of fibers and will not affect the position of the fibers in that circumference portion of the feed roller to which a vacuum is applied. The axial distance between said circumference portion of the feed roller and the juxtaposed zone to which a vacuum is applied is of minor significance because it is merely essential that the coherence between fibers extending between the two streams of fibers is eliminated and that the fibers are pulled apart toward the two circumference portions to which a vacuum is applied.

The proportion in which the fibers fed toward the twisting space on the feed roller are distributed to a stream of fibers for forming the core fibers of the yarn to be made and to a stream of covering fibers for said yarn will depend on the axial position of the roving relative to that intermediate portion of the feed roller to which no vacuum is applied so that said proportion can be controlled also by a axial displacement of the roving. The proportion of covering fibers can be selected as desired and may be kept very small by a proper selection of the path in which the drawn roving is moved relative to the intermediate portion to which no vacuum is applied.

The fanning of the stream of covering fibers supplied to the twisting space can be promoted and a desired mean helix angle of the covering fibers wound around the core fibers will be obtained if at least part of the holes through which the air blast leaves the feed roller are so inclined that a divergent air blast is obtained. As a result, the individual covering fibers will be aligned with the flow lines of the air blast and will be supplied in the form of a widely fanned stream to the twisting space.

To ensure that the stream of core fibers which are fed to the twisting space on that circumference portion of the feed roller to which a vacuum is applied can freely be deflected from the peripheral direction of the feed roller into the axial direction in which the yarn is withdrawn and that said deflection of the stream of core fibers will not adversely affect the winding of the blown off covering fibers about said core fibers, the twisting space may have a continuation which is defined by the feed roller and by that twisting drum which at the twisting space rotates away from the vertex of said space and which is axially extended into the axial extend of the blasting zone. Owing to that design, a space is provided for accommocating a pressure-applying roller, which contacts and defines a nip with the feed roller at the delivery end of the circumference portion to which a vacuum is applied, and said nip is adapted to receiving the stream of fibers which are fed on the circumference portion to which a vacuum is applied so that said stream of fibers will be deflected at a point which is determined by the pressure-applying roller.

A particularly desirable design will be obtained if the feed roller is constituted by one of the delivery rollers of a drawing frame because in that case the constraint of the drawn fibers delivered by the drawing frame will not be eliminated as that roving is transferred to a feed roller which succeeds the drawing frame.

If the fibers of the stream which has been detached from the feed roller are subjected to predetermined flight parameters, they will fly along a predetermined flight path so that their flight path need not be changed if the location of the blasting zone is so selected that the blown-off fibers enter the twisting space and reach the line of yarn formation. The position of the blasting zone will depend also on the size of the feed roller so that the diamenter of the feed roller can be so selected in adaptation to the flight distance of the fibers which have been blown off that said fibers will reliably reach the line of yarn formation. That diameter should be so selected that a change of the flight path, which is determined by the predetermined flight parameters, will not be required. In such case there will be no disturbing influences which would be due to a change of the flight path so that the blown off fibers will enter the twisting space uniformly and without a disturbance. The diameter of the feed roller is usually increased for that adaptation and in other respects does not influence the result of the spinning operation.

The turbulence of the air stream entraining the fibers which have been detached from the feed roller and enter the twisting space should be minimized. This can be accomplished by the provision of a fiber-guiding passage, which extends from the feed roller into the twisting space and effects an additional guidance of the stream of fibers which have been blown off. That guidance is due to the fact that the suction stream flowing in the twisting space is effective also in the fiber-guiding passage so that the directing effect of the air blast entraining the fibers from the blasting zone of the feed roller into the fiber-guiding passage will be assisted by the negative pressure existing at the outlet end of said passage adjacent to the twisting space. This action will be assisted by the fact that the various controlling variables can be so selected that a substantially laminar flow can be obtained in the fiber-guiding passage. Owing to the provision of the fiber-guiding passage the movement of the fibers which have been detached from the feed roller and move into the twisting space will not be subject to external influences. Besides, such fiber-guiding passage may be designed to ensure that a suction stream will be obtained which is sufficient for a separation of the stream of covering fibers from the feed roller so that the use of an air blast delivered through the shell of the feed roller may not be required.

If the fiber-guiding passage flares toward the twisting space in the direction in which the yarn is withdrawn, the covering fibers will be applied to the line of yarn formation over a wider range so that any irregularities in the distribution of the covering fibers will be compensated. An additional fanning and equalization of the stream of fibers which have been detached from he feed roller can be accomplished in the fiber-guiding passage if the fiber-guiding passage is formed adjacent to that passage-defining wall which is remote from the feed roller with at least one air inlet opening for delivering an injected air stream. A desired influence on the distribution of fibers over the cross-section of the fiber-guiding passage can also be exerted in that at least one air inlet opening for delivering an air blast in formed in that passage-defining wall which is remote from the feed roller so that said air blast will exert a controlled influence on the movement of the fibers in the fiber-guiding passage.

BRIEF DESCRIPTION OF THE DRAWING

FIG. 3 is a sectional view taken on line III—III in FIG. 1.

FIG. 4 is an enlarged sectional view corresponding to FIG. 5.

FIG. 5 is a sectional view taken on line V—V in FIG. 4.

DETAILED DESCRIPTION OF THE PREFERRED EMBODIMENT

Figure 1:
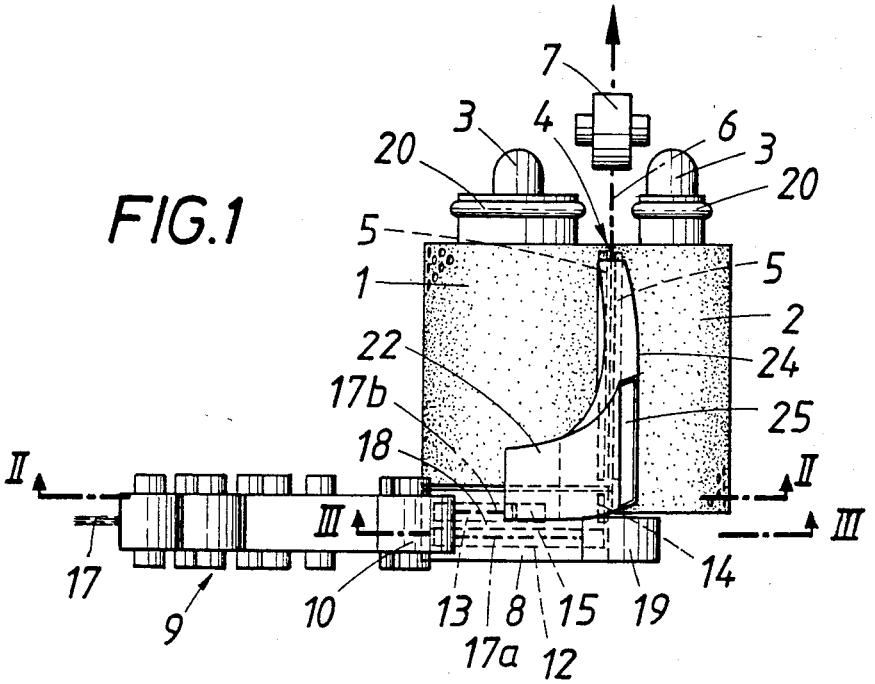
FIG. 1 is a diagrammatic top plan view showing yarn-making apparatus in accordance with the invention.

An illustrative embodiment of the invention is shown on the drawing.

The embodiment shown by way of example comprises two juxtaposed, closely spaced apart, air-permeable twisting drums 1 and 2, which rotate in the same sense and are provided with suction inserts 3, which at the generally triangular twisting space 4 defined between the two twisting drums 1 and 2 constitute axially extending suction zones 5. As a result, fibers entering the twisting space 4 will be twisted together between the two twisting drums 1 and 2 so as to form a yarn 6, which can be withdrawn from the twisting space 4 by withdrawing means 7.

Fibers are supplied to the twisting space 4 by means of a feed roller 8, which in the illustrated embodiment constitutes one delivery roller of a drawing frame 9, which has a second delivery roller 10. The feed roller 8 axially precedes that twisting drum 1 which at the twisting space 4 rotates toward the vertex thereof. The twisting drum 2 is axially extended relative to the twisting drum 1 and together with the feed roller defines a continuation of the twisting space 4.

Figure 2:
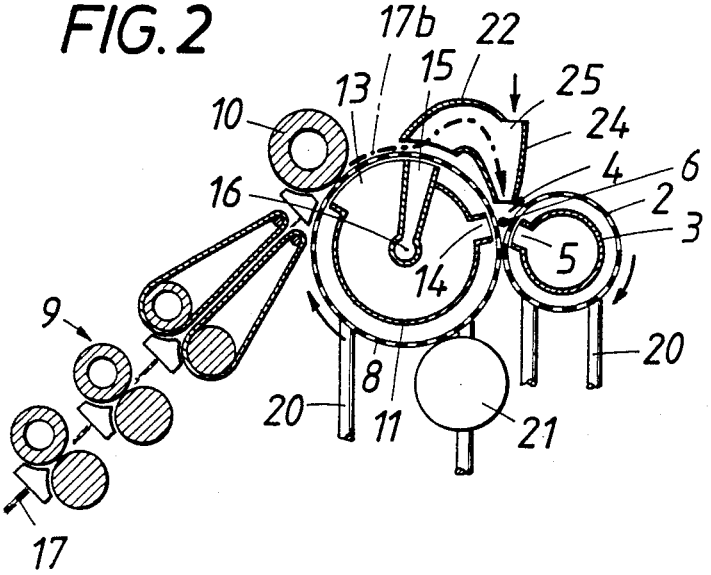
FIG. 2 is a sectional view taken on line II—II in FIG. 1 and showing that apparatus.

As is particularly apparent from FIGS. 2, 3 and 4 the feed roller 8 is also provided with a suction insert 11, which has a circumferential slot 12, to which a vacuum is applied, and with two suction zones 13 and 14, which extend along and are axially spaced from the circumferential slot 12 on that side thereof which faces the twisting drum 1. The delivery end of the circumferential slot is axially aligned with the suction zone 5 of the adjacent twisting drum 1. The suction zone 14 faces the twisting space 4 and is axially aligned with the suction slot 5 of the adjacent twisting drum 1 and with the delivery end of the circumferential slot 12. A blasting zone 15 is provided between the suction zones 13 and 14 and is supplied with blowing air through a compressed air pipe 16. Because that circumference portion of the feed roller 8 which is defined by the circumferential slot 12 and to which a vacuum is applied is closely spaced from the blasting zone, the roving 17 which has been drawn in the drawing frame 9 and is conveyed on the feed roller 8 will partly move adjacent to the circumferential slot 12 and will partly enter the blasting zone 15 so that the roving 17 will be divided into two streams of fibers **17*a* and 17*b*. To ensure a division of the roving 17 into two streams of fibers 17*a* and 17*b*, a zone 18 to which no vacuum is applied is provided between the circumferential portion 12 in which a vacuum is applied to the surface of the feed roller 8 and the suction zone 13, which is axially spaced from said circumferential portion 12. Those fibers of the drawn roving 17 which leave the drawing frame 9 and enter the zone 18 to which no vacuum is applied will be pulled apart toward the circumferential portion 12 to which a vacuum is applied and toward the suction zone 13 so that the coherence between the fibers will be eliminated and the roving 17 in that zone 18 of the feed roller 8 to which no vacuum is applied will be divided into the two spaced apart streams of fibers 17*a* and 17*b*. The ratio between said streams of fibers 17*a* and 17*b* will depend on the position of the roving 17 relative to the zone 18 to which no vacuum is applied. In this manner it is possible to separate from the drawn roving 17 a stream of covering fibers 17*b* at a relatively low rate because the division of the roving 17 into two streams of fibers 17*a* and 17*b*** is effected after the roving has been drawn.

The stream of fibers **17*a* is constrained as it is moved on the feed roller 8 along the circumferential slot 12 of the suction insert 11 and finally reaches a pressure-applying roller 19 at the delivery end of the circumferential slot 12. The pressure-applying roller 19 cooperates with the feed roller 8 to define a nip in which the stream of fibers 17*a* is deflected from the circumferential direction to the axial direction in which the yarn is withdrawn. The deflection of the stream of fibers 17*a* is assisted by the vacuum applied to the suction zone 14**.

The fibers of the stream **17*b* which have entered the blasting zone are blown off from the feed roller 8 so that they fly freely as they enter the twisting space. But said detached fibers will have the desired alignment because the fibers have been will still be retained on the feed roller 8 in the suction zone 13 when the leading ends of the fibers are blown off in the blasting zone 15 toward the twisting space 4**.

As a result of the division of the roving 17, the stream of fibers **17*b* which have been blown off will be wound around the core fibers of the stream 17*a* at a helix angle which differs from the helix angle of the core fibers so that a covered yarn is obtained although only a single roving 17** has been supplied.

The streams of fibers **17*a*, 17*b* can be fed at a speed which is independent of the surface velocity of the twisting drums 1 and 2 if the feed roller 8 is driven independently of the twisting drums 1 and 2. The twisting drums 1 and 2 are driven by means of belt drives 20 and the feed roller 8 is driven by means of a friction wheel 21**.

To ensure that the fibers which have been blown off from the feed roller 8 will enter the twisting space 4 uniformly and without a disturbance, a fiber-guiding passage 22 is provided, by which the stream of fibers 17*b* which has been blown off from the feed roller 8 are received and guided into the twisting space 4 defined by the two twisting drums 1 and 2. As is apparent from FIG. 1, that fiber-guiding passage 22 flares toward the twisting space 4 in the direction in which the yarn is withdrawn so that the fibers which have been blown off from the feed roller 8 will reach the line of yarn formation over a larger length thereof and any irregularities of the distribution of the fibers in the stream 17*b* can be compensated at least in part. The desirable fanning of the stream of fibers 17*b* will also be promoted if the holes 23 formed in the feed roller 8 in the axial range of the blasting zone 15 are outwardly inclined toward the twisting drum 1 as is apparent from FIG. 5 so that the covering fibers will enter the twisting space 4 at a smaller angle.

That passage-defining wall 24 which in a transverse sectional view is remote from the feed roller 8 is formed with an air inlet opening 25, which extends throughout the width of the passage and admits an injected air stream to the passage. That air stream exerts a controlled influence on the distribution of fibers in the fiber-guiding passage 22 and promotes the fanning of the stream of fibers 17*b*.

As is apparent from FIGS. 2 and 4 the configuration of the fiber-guiding passage 22 conforms to the flight path of the fibers which have been blown off so that the fibers will not be subjected to unnecessary deflections in the fiber-guiding passage 22, from which the fibers enter the twisting space 4 in a substantially laminar stream of entraining air. That stream of entraining air in the fiber-guiding passage 22 is influenced by the air blast from the feed roller 8 and by the stream of air which is sucked toward the suction zone 5 so that the fibers are entrained by a substantially closed flow pattern. If the negative pressure in the fiber-guiding passage 22 is sufficient for detaching the fibers of the stream 17*b* from the feed roller 8, the blasting zone 15 can be eliminated. The action of the air stream sucked through the fiber-guiding passage 22 to detach the fibers from the feed roller 8 is assisted by the centrifugal forces, which are fully effective in the region which adjoins the suction zone 13 and which otherwise constitutes the blasting zone.

The ensure that the stream of blown-off fibers 17*b* will not be deflected as they fly into the twisting space 4 along the parabolic flight path determined by the predetermined flight parameters, the diameter of the feed roller 8 has been selected in consideration of the distance over which the fibers fly when they have been blown off. For this purpose it is generally necessary to provide a feed roller 8 which is larger in diameter than the other delivery roller 10 of the drawing frame 9. In a preferred arrangement the twisting drum 1, which adjacent to the twisting space 4 rotates toward the vertex of said space, has the same diameter as the feed roller 8 so that the feed roller 8 and the twisting drum 1 can be coaxially arranged.

I claim:

1. In a process of making a covered yarn comprising a core consisting of core fibers and a covering consisting of covering fibers wound around said core, which process comprises twisting a stream of drawn core fibers in a generally triangular twisting space defined by two juxtaposed, closely spaced apart twisting drums rotating in the same sense, and winding said covering fibers around said core fibers as they are twisted in said twisting space, whereby a covered yarn is formed, the improvement residing in that a drawn roving is moved on the circumference of a rotating feed roller into said twisting space and is subjected to a vacuum tending to hold said roving on said circumference, said roving is divided on said circumference into first and second streams consisting of said core fibers and covering fibers, respectively, said first stream is moved on said circumference while the action of said vacuum on said first stream is maintained, and said covering fibers are detached from said feed roller and are caused to fly freely into said twisting space.

2. The improvement set forth in claim 1, wherein an air blast is caused to flow through the circumference of said feed roller and to detach said covering fibers from said feed roller.

3. The improvement set forth in claim 1, wherein said covering fibers are sucked from said feed roller.

4. In apparatus for making a covered yarn comprising a core consisting of core fibers and a covering consisting of covering fibers wound around said core, which apparatus comprises two juxtaposed, closely spaced apart twisting drums defining a generally triangular twisting space core fiber-supplying means for supplying a stream of drawn core fibers to said twisting space, drum-driving means for rotating said twisting drums in the same sense so that one of said twisting drums rotates at said twisting space toward the vertex thereof and said stream of core fibers is twisted in said twisting space, covering fiber-supplying means for supplying said covering fibers to said twisting space so that said covering fibers are wound around said core fibers as the latter are twisted in said twisting space so as to form a covered yarn on a predetermined line of yarn formation, and withdrawing means for withdrawing said covered yarn from one end of said twisting space, the improvement residing in that said core fiber-supplying means comprise a feed roller, which is adapted to receive on its circumference a drawn roving and is rotatable in a predetermined sense to move said drawn roving on said circumference toward said twisting space, roller-driving means for rotating said feed roller in said predetermined sense, and constraining means for subjecting said drawn roving on the circumference of said feed roller to a vacuum tending to hold said drawn roving on said circumference, said apparatus also comprises dividing means for dividing said roving on the circumference of said feed roller into first and second streams consisting of said core fibers and covering fibers, respectively, said feed roller is rotatable in said predetermined sense to move said first stream on the circumference of said feed roller into said twisting space, said constraining means are adapted to subject said first stream to said vacuum until said first stream is about to enter said twisting space, and said core fiber-supplying means comprise means for detaching said covering fibers of said second stream from said feed roller and to cause said covering fibers to fly freely into said twisting space.

5. The improvement set forth in claim 4 as applied to apparatus comprising a drawing frame comprising two delivery rollers for delivering said drawn roving, wherein said feed roller consists of one of said delivery rollers.

6. The improvement set forth in claim 4, wherein said covering fiber-supplying means are operable to cause said covering fibers to fly into said twisting space over a predetermined distance on a predetermined flight path controlled by predetermined flight parameters and said feed roller has such a diameter that said covering fibers flying into said twisting space over said distance will reach said line of yarn formation.

7. The improvement set forth in claim 4, wherein said feed roller is disposed near said one twisting drum at said end thereof which is opposite to said one end of said twisting space, said roller-driving means are operable to rotate said feed roller in the same sense as said one twisting drum, said constraining means comprise means for applying a vacuum to a circumferentially extending strip on the circumference of said feed roller, and said covering fiber-supplying means comprise blasting means for delivering an air blast through the circumference of said feed roller in a blasting zone which is axially spaced from said strip on the side thereof which faces said one twisting drum.

8. The improvement set forth in claim 7, wherein said dividing means comprise means for applying a vacuum to said circumference in a suction zone which is axially spaced from said strip on the side thereof which faces said one twisting drum, said suction zone being disposed on that side of said blasting zone which is opposite to said twisting space, and means for preventing the application of a vacuum to the circumference of said feed roller in an area disposed between said strip and said suction zone.

9. The improvement set forth in claim 7, wherein said blasting means comprise a plurality of passages formed in the circumference of said feed roller and at least part of said passages are so inclined that said blasting means are operable to deliver through the circumference of said feed roller an air blast which diverges in the direction of said line of yarn formation.

10. The improvement set forth in claim 7, wherein the other of said twisting drums protrudes axially from said one twisting drums as far as into the axial extent of said blasting zone, and said feed roller and said other twisting drum define a continuation of said twisting space.

11. The improvement set forth in claim 7, wherein said strip has a delivery end which is axially aligned with said twisting space and a pressure-applying roller is in contact with said feed roller near the delivery end of said strip.

12. The improvement set forth in claim 7, wherein said covering fiber-supplying means comprise means defining a fiber-guiding passage extending between said blasting zone and said twisting space.

13. The improvement set forth in claim 12, wherein said fiber-guiding passage flares toward said twisting space in the direction of said line of yarn formation.

14. The improvement set forth in claim 13, wherein said blasting means comprise a plurality of passages formed in the circumference of said feed roller and at least part of said passages are so inclined that said blasting means are operable to deliver through the circumference of said feed roller an air blast which diverges in the direction of said line of yarn formation.

15. The improvement set forth in claim 12, wherein said means defining said fiber-guiding passage comprise a first wall adjacent to said feed roller and a second wall remote from said feed roller and said second wall is formed with at least one air inlet opening for injecting of air stream into said fiber-guiding passage.

16. The improvement set forth in claim 12, wherein said means defining said fiber-guiding passage comprise a first wall adjacent to said feed roller and a second wall remote from said feed roller and said second wall is formed with at least one air inlet opening for admiting an air blast to said fiber-guiding passage.

* * * * *